US011225983B2

(12) United States Patent
Shimada

(10) Patent No.: US 11,225,983 B2
(45) Date of Patent: Jan. 18, 2022

(54) FLUID CIRCUIT

(71) Applicant: EAGLE INDUSTRY CO., LTD., Tokyo (JP)

(72) Inventor: Yoshiyuki Shimada, Tokyo (JP)

(73) Assignee: EAGLE INDUSTRY CO., LTD.

( * ) Notice: Subject to any disclaimer, the term of this patent is extended or adjusted under 35 U.S.C. 154(b) by 0 days.

(21) Appl. No.: 17/276,918

(22) PCT Filed: Sep. 25, 2019

(86) PCT No.: PCT/JP2019/037447
§ 371 (c)(1),
(2) Date: Mar. 17, 2021

(87) PCT Pub. No.: WO2020/067084
PCT Pub. Date: Apr. 2, 2020

(65) Prior Publication Data

US 2021/0372088 A1 Dec. 2, 2021

(51) Int. Cl.
*F15B 11/16* (2006.01)
*E02F 9/22* (2006.01)

(52) U.S. Cl.
CPC ..... *F15B 11/165* (2013.01); *E02F 9/2225* (2013.01); *E02F 9/2232* (2013.01); *E02F 9/2285* (2013.01); *E02F 9/2296* (2013.01); *F15B 11/163* (2013.01); *F15B 11/166* (2013.01); *E02F 9/2292* (2013.01); *F15B 2211/20553* (2013.01)

(58) Field of Classification Search
None
See application file for complete search history.

(56) References Cited

U.S. PATENT DOCUMENTS 6,526,747 B2 * 3/2003 Nakatani ..... F15B 11/165 60/399
10,288,094 B2 * 5/2019 Spielvogel ..... E02F 9/2232

FOREIGN PATENT DOCUMENTS

JP 3-74605 3/1991 ..... F15B 11/00
JP 2008-185182 8/2008 ..... F15B 21/14
JP 2008-190694 8/2008 ..... F15B 11/00

OTHER PUBLICATIONS

International Search Report and Written Opinion issued in PCT/JP2019/037447, dated Dec. 17, 2019, with English translation 12 pages.
International Preliminary Report on Patentability issued in PCT/JP2019/037447, dated Apr. 8, 2021, English translation, 7 pages.

* cited by examiner

*Primary Examiner* — Michael Leslie
(74) *Attorney, Agent, or Firm* — Hayes Soloway P.C.

(57) ABSTRACT

A fluid circuit includes a pressure fluid source configured to supply pressure fluid, multiple actuators connected to the pressure fluid source, a direction switching valve configured to switch a supply destination of the pressure fluid supplied from the pressure fluid source, and a discharge amount control mechanism configured to control the output pressure of the pressure fluid source such that a pressure difference ΔP between the output pressure of the pressure fluid source and the maximum load pressure of the load pressures of the multiple actuators reaches a target value ΔPt. The fluid circuit further includes an accumulator configured to accumulate part of return fluid from the actuators.

12 Claims, 7 Drawing Sheets

FLUID CIRCUIT

TECHNICAL FIELD

The present invention relates to a fluid circuit configured such that pressure fluid flows into an actuator from a pressure fluid source to drive a load.

BACKGROUND ART

Typically, a fluid circuit configured such that pressure fluid such as oil flows into an actuator from a pressure fluid source to drive a load has been used for driving a vehicle, a construction machine, an industrial machine, etc. For example, a hydraulic shovel supplies pressure fluid from a hydraulic pump to multiple actuators connected in parallel with a hydraulic circuit as a fluid circuit in a fluid manner, such as a bucket cylinder and an arm cylinder, thereby simultaneously driving and operating multiple loads. Various modification have been made considering improvement of operability, energy saving, acceleration, and safety.

In a typical example of the fluid circuit, a hydraulic circuit of an open center system applied to, e.g., a hydraulic shovel is configured such that at a neutral position of a direction switching valve connected to an actuator and an operation lever, pressure fluid from a hydraulic pump as a pressure fluid source is discharged to a tank by way of a bypass flow path and a pilot pressure based on an operation amount of an operation lever strokes a spool of the direction switching valve to obtain the actuation speed of the actuator according to the operation amount of the operation lever. However, in this system, in a case where a high load pressure is on the actuator, the operation lever needs to be operated to a high output side.

A fluid circuit of a load sensing system configured to make such control that the supply pressure of a hydraulic pump is constantly higher than the maximum load pressure of multiple actuators by a target pressure difference has been known as a fluid circuit solving the above-described problem (see Patent Citation 1). As an example of the fluid circuit of the load sensing system as described above, a fluid circuit illustrated in FIG. 7 mainly includes a swash plate type variable capacity hydraulic pump 102 to be driven by a drive mechanism such as an engine or an electric motor, two actuators 108, 109 connected in parallel with the hydraulic pump 102 in a fluid manner, two direction switching valves 106, 107 connected to each of the actuators 108, 109 and operation levers 110, 111 to switch a supply destination of pressure fluid supplied from the hydraulic pump 102, pressure compensation valves 104, 105 provided at pressure-fluid-source-side flow paths of the direction switching valves 106, 107, and a load sensing valve 141 and a swash plate control unit 142 as a discharge amount control mechanism configured to control a pressure fluid discharge amount (the output) of the hydraulic pump 102. The actuator maximum load pressure, which is selected by a shuttle valve 116 for the load sensing valve 141, as a higher one of the load pressures of two actuators 108, 109 through a pilot pipe line 120 and the supply pressure of the hydraulic pump 102 from the pressure-fluid-source-side flow paths of the direction switching valves 106, 107 are guided to the load sensing valve 141. Then, the degree of opening of the load sensing valve 141 is adjusted such that a difference between the supply pressure of the hydraulic pump 102 and the actuator maximum load pressure, i.e., a pressure difference (also referred to as a direction switching valve pressure difference) between a pressure fluid source side of the direction switching valve 106, 107 and an actuator 108, 109 side, reaches a target value (e.g., a constant value). Inclination of a swash plate 143 is increased/decreased by the swash plate control unit 142, and in this manner, the output of the hydraulic pump 102 is controlled. Thus, in the fluid circuit of the load sensing system, in a case where a high load pressure is on the actuators 108, 109, the fluid circuit can respond to fluctuation in the load pressures of the actuators 108, 109 by control by the discharge amount control mechanism.

CITATION LIST

Patent Literature

Patent Citation 1: JP 3-74605 A (Page 28, FIG. 1)

SUMMARY OF INVENTION

Technical Problem

However, in the fluid circuit of the load sensing system of FIG. 7, in a case where a high load acts on two actuators, an appropriate hydraulic pump for such a load may be used. However, a large hydraulic pump needs to be provided, leading to a problem that an energy efficiency is degraded.

The present invention has been made in view of such a problem, and is intended to provide a high-energy-efficiency fluid circuit using a load sensing system.

Solution to Problem

For solving the above-described problem, a fluid circuit according to the present invention is a fluid circuit including a pressure fluid source configured to supply pressure fluid, multiple actuators connected to the pressure fluid source, a direction switching valve configured to switch a supply destination of the pressure fluid supplied from the pressure fluid source, and a discharge amount control mechanism configured to control output pressure of the pressure fluid source such that a pressure difference between the output pressure of the pressure fluid source and the maximum load pressure of the load pressures of the multiple actuators reaches a target value, which includes an accumulator configured to accumulate part of return fluid from the actuators, the accumulator being able to discharge the pressure fluid from the accumulator to a pressure-fluid-source-side flow path of the direction switching valve, and adjustment means configured to adjust a control amount of the pressure fluid source based on the pressure of the accumulator being further provided. According to the aforementioned feature of the present invention, the fluid circuit configured to make such control that the supply pressure of the pressure fluid source is constantly higher than the maximum load pressure of the multiple actuators by the target pressure difference can compensate for the output pressure of the pressure fluid source according to the pressure of the accumulator capable of discharging the pressure fluid to the pressure-fluid-source-side flow path of the direction switching valve. Thus, a high-energy-efficiency fluid circuit can be provided.

It may be preferable that the control amount is adjusted by the adjustment means when the pressure fluid is discharged from the accumulator to the pressure-fluid-source-side flow path of the direction switching valve. According to this preferable configuration, the output pressure of the pressure fluid source can be adjusted at proper timing, and therefore, a favorable energy efficiency is provided.

It may be preferable that the fluid circuit further includes pressure detection means configured to detect the pressure of the accumulator, and a control unit having an arithmetic circuit, the adjustment means being actuated by an electric signal output from the control unit based on the pressure detected by the pressure detection means. According to this preferable configuration, favorable adjustment means responsiveness is provided.

It may be preferable that the discharge amount control mechanism includes a load sensing valve configured to adjust an opening degree of the load sensing valve based on a difference between pressure-fluid-source-side pressure and actuator-side pressure of the direction switching valve guided by a pilot pipe line, and a pressure reduction valve as the adjustment means is provided at the pilot pipe line guiding the actuator-side pressure of the direction switching valve. According to this preferable configuration, the degree of opening of the load sensing valve can be adjusted based on the value obtained from the actuator maximum load pressure and the accumulator pressure, and a control amount by the discharge amount control mechanism can be adjusted by a simple circuit.

It may be preferable that a pressure reduction amount in the pressure reduction valve is adjusted based at least on the pressure-fluid-source-side pressure and the actuator-side pressure of the direction switching valve and the pressure of the accumulator. According to this preferable configuration, the pressure reduction amount in the pressure reduction valve can be adjusted based on the pressure-fluid-source-side pressure and the actuator-side pressure of the direction switching valve and the pressure of the accumulator, and therefore, the direction switching valve pressure difference can be quickly controlled to the target value.

DESCRIPTION OF EMBODIMENTS

Hereinafter, a mode for carrying out a fluid circuit according to the present invention will be described based on an embodiment.

Embodiment

A hydraulic circuit of a shovel loader will be described as an example of a fluid circuit according to an embodiment of the present invention with reference to FIGS. 1 to 6.

Figure 1:
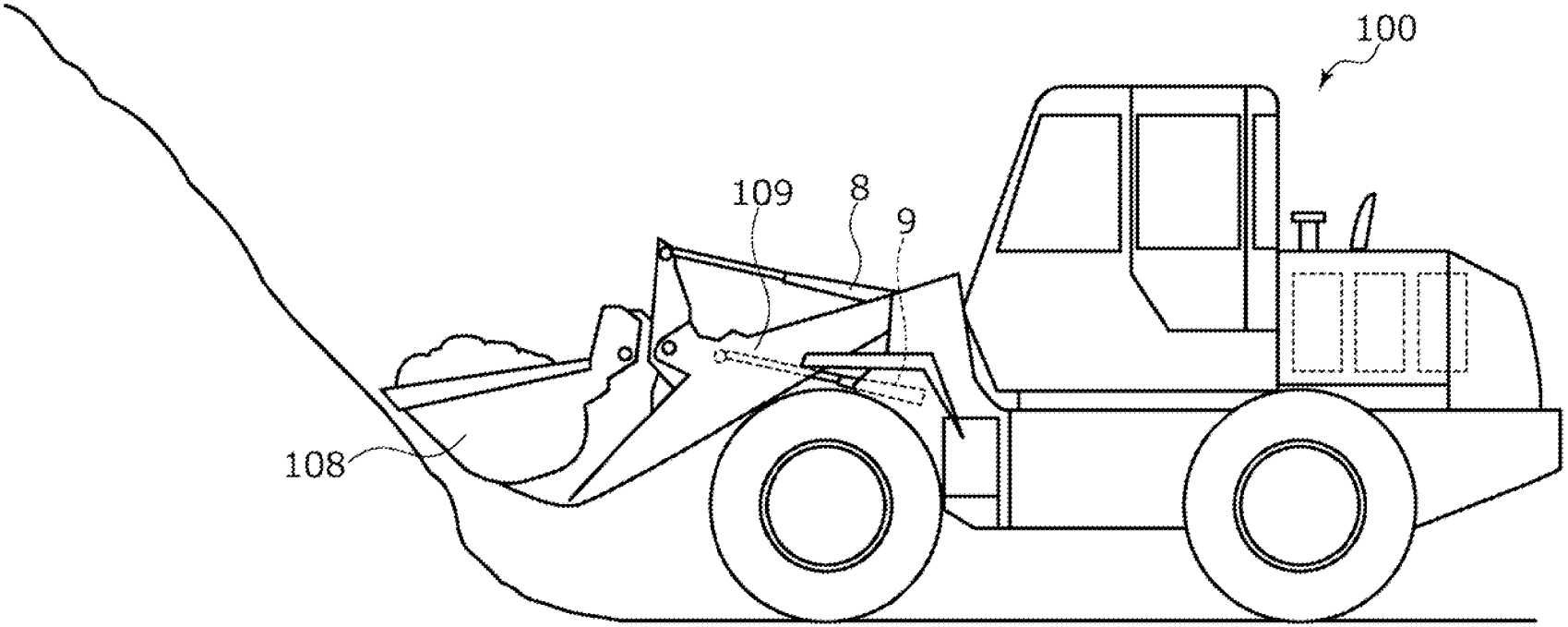
FIG. 1 is a side view of a shovel loader provided with a fluid circuit according to an embodiment of the present invention.

As illustrated in FIG. 1, the shovel loader 100 has a bucket 108 (shown as W2 in FIG. 2) configured to house dirt etc., a lift arm 109 (shown as W1 in FIG. 2) link-connected to the bucket 108, and a bucket cylinder 8 and an arm cylinder 9 as actuators each configured to drive these components by a hydraulic pressure. Hereinafter, a hydraulic circuit as a fluid circuit of a load sensing system used for the bucket cylinder 8 and the arm cylinder 9 will be described.

Figure 2:
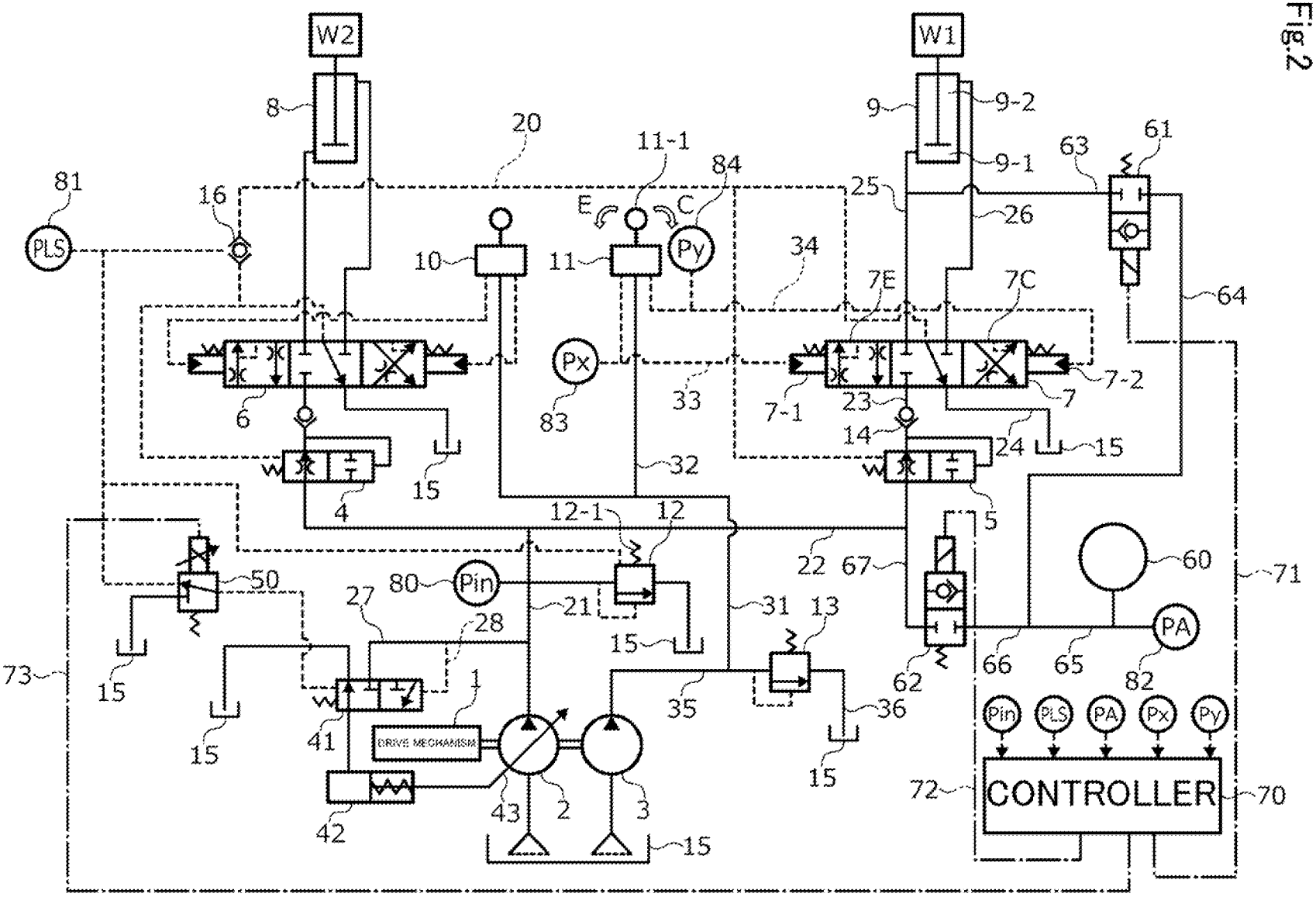
FIG. 2 is a diagram for describing a hydraulic circuit of a load sensing system in the embodiment.

As illustrated in FIG. 2, the hydraulic circuit mainly includes a main hydraulic pump 2 and a pilot hydraulic pump 3 as a variable capacity pressure fluid source to be driven by a drive mechanism 1 such as an engine or an electric motor, a bucket direction switching valve 6 and an arm direction switching valve 7 as direction switching valves configured to switch a supply destination of hydraulic oil as pressure fluid to be supplied from the main hydraulic pump 2, pressure compensation valves 4, 5 connected to pressure fluid source sides of the bucket direction switching valve 6 and the arm direction switching valve 7, the bucket cylinder 8 and the arm cylinder 9 connected to actuator sides of the bucket direction switching valve 6 and the arm direction switching valve 7, a bucket hydraulic remote control valve 10 and an arm hydraulic remote control valve 11 configured to switch the supply destination of the hydraulic oil to be supplied from the pilot hydraulic pump 3, a load sensing valve 41 and a swash plate control device 42 as a discharge amount control mechanism configured to control the output of the main hydraulic pump 2, an electromagnetic proportional pressure reduction valve 50 as adjustment means and a pressure reduction valve provided at a secondary pressure pilot pipe line 20 as a pilot pipe line, and an accumulator 60 configured to accumulate part of return oil from the arm cylinder 9. Note that a bucket-cylinder-8-side hydraulic circuit and an arm-cylinder-9-side hydraulic circuit connected in parallel with the main hydraulic pump 2 and the pilot hydraulic pump 3 in a fluid manner have the substantially same configuration, and therefore, the arm-cylinder-9-side hydraulic circuit will be described and description of the bucket-cylinder-8-side hydraulic circuit will be omitted.

The main hydraulic pump 2 and the pilot hydraulic pump 3 are coupled to the drive mechanism 1, and are rotated by power from the drive mechanism 1 to supply the hydraulic oil through oil paths each connected to these pumps.

As illustrated in FIG. 2, the hydraulic oil discharged from the main hydraulic pump 2 flows into the arm direction switching valve 7 through oil paths 21, 22, the pressure compensation valve 5, a check valve 14, and an oil path 23. The arm direction switching valve 7 is a five-port three-position type normally-closed pilot direction switching valve, and at a neutral position thereof, the oil path 23 and a head-side oil path 25 and a rod-side oil path 26 of the arm cylinder 9 are closed and the secondary pressure pilot pipe line 20 is connected to an oil path 24 and a tank 15. Moreover, the arm direction switching valve 7 is configured such that at an extension position 7E, the oil path 23 is connected to the head-side oil path 25 and the secondary pressure pilot pipe line 20 and the rod-side oil path 26 is connected to the oil path 24 and the tank 15. Further, the arm direction switching valve 7 is configured such that at a contraction position 7C, the head-side oil path 25 is connected to the oil path 24 and the tank 15 and the oil path 23 is connected to the rod-side oil path 26 and the secondary pressure pilot pipe line 20.

In addition, when the arm direction switching valve 7 is at the extension position 7E or the contraction position 7C, the secondary pressure, i.e., the actuator-side pressure, of the arm direction switching valve 7 is guided to an unload valve 12 and the electromagnetic proportional pressure reduction valve 50 through a shuttle valve 16 by the secondary pressure pilot pipe line 20. Note that the actuator-side pressures of the bucket direction switching valve 6 and the arm direction switching valve 7, i.e., the load pressures of the bucket cylinder 8 and the arm cylinder 9, are guided to the shuttle valve 16 by the secondary pressure pilot pipe line 20, and the shuttle valve 16 selects an actuator maximum load pressure as a higher one of the load pressures of the bucket cylinder 8 and the arm cylinder 9 to guide such a pressure to the unload valve 12 and the electromagnetic proportional pressure reduction valve 50.

Figure 3:
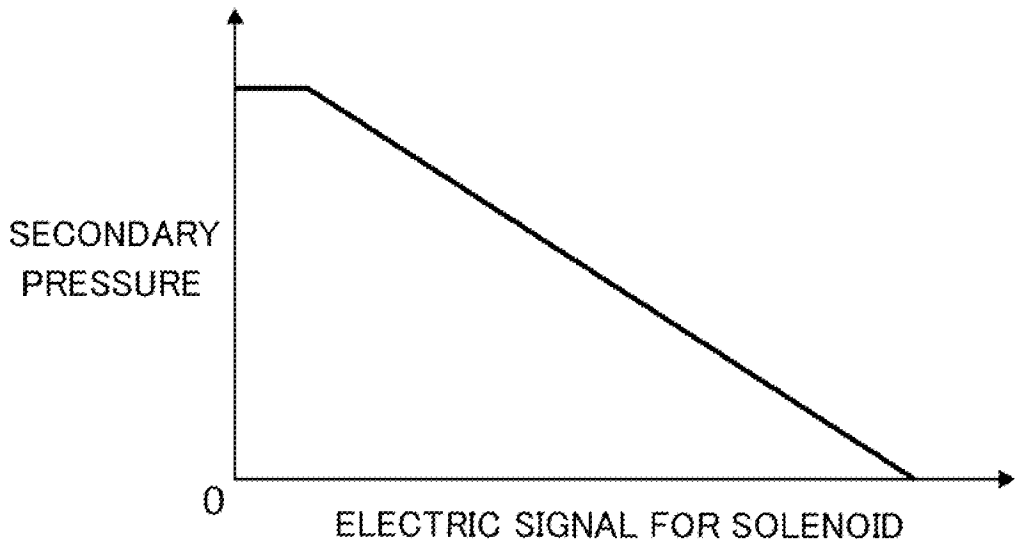
FIG. 3 is a graph for describing a relationship between an electric signal for a solenoid and a secondary pressure in an electromagnetic proportional pressure reduction valve in the embodiment.

As illustrated in FIG. 3, the electromagnetic proportional pressure reduction valve 50 has such pressure characteristics that the secondary pressure is proportionally decreased according to an increase in an electric signal for a solenoid. A controller 70 as a control unit including an arithmetic circuit is connected to the electromagnetic proportional pressure reduction valve 50 through an electric signal line 73. The electromagnetic proportional pressure reduction valve 50 adjusts a pressure reduction amount (or an opening degree) according to an electric signal from the controller 70 to release part of the actuator maximum load pressure selected by the shuttle valve 16 to the tank 15, and therefore, the secondary pressure can be reduced. Moreover, the electromagnetic proportional pressure reduction valve 50 is provided on a primary side of the load sensing valve 41 at the secondary pressure pilot pipe line 20.

The actuator maximum load pressure adjusted by the electromagnetic proportional pressure reduction valve 50, i.e., the actuator-side pressure of the direction switching valve, is guided to the load sensing valve 41 through the secondary pressure pilot pipe line 20, and the supply pressure of the main hydraulic pump 2, i.e., the pressure-fluid-source-side pressure of the direction switching valve, is guided to the load sensing valve 41 through a primary pressure pilot pipe line 28 as a pilot pipe line branched from a pipe line 27 branched from the oil path 21. The degree of opening of the load sensing valve 41 is adjusted based on a difference between the supply pressure of the main hydraulic pump 2 and the actuator maximum load pressure adjusted by the electromagnetic proportional pressure reduction valve 50, i.e., a pressure difference between the pressure fluid source side of the direction switching valve and the actuator side of the direction switching valve adjusted by the electromagnetic proportional pressure reduction valve 50. With such an opening degree, a pump flow rate control pressure can be controlled. Moreover, the swash plate control device 42 is actuated according to the hydraulic oil (hereinafter referred to as the "pump flow rate control pressure") supplied from the load sensing valve 41, and the angle of inclination of a swash plate 43 of the main hydraulic pump 2 is increased/decreased such that the output of the main hydraulic pump 2 is controlled.

Figure 4:
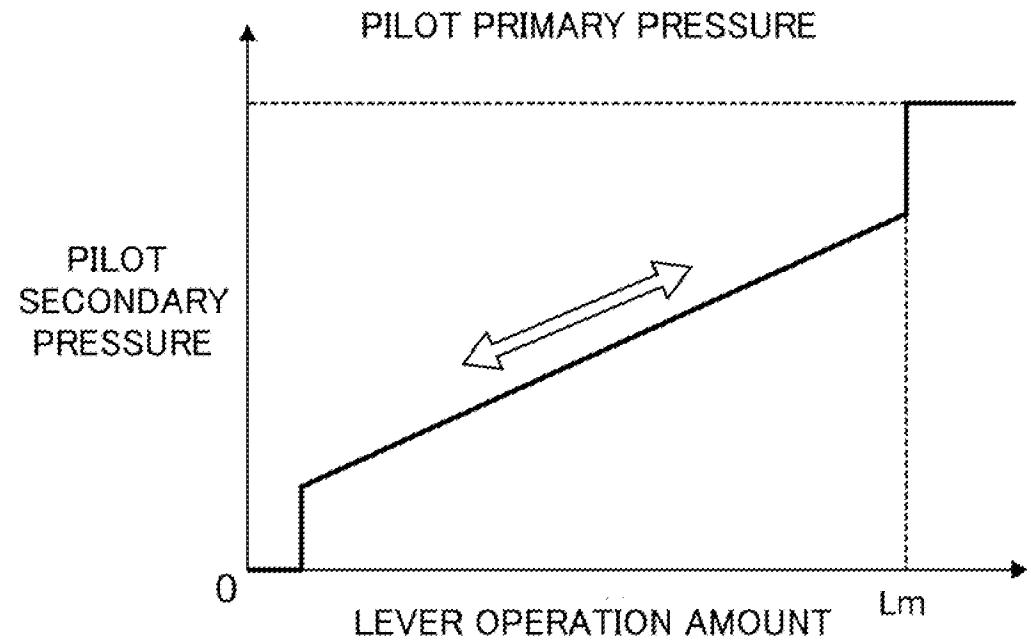
FIG. 4 is a graph for describing a relationship between a lever operation amount and a pilot secondary pressure in a hydraulic remote control valve in the embodiment.

As illustrated in FIG. 2, the hydraulic oil discharged from the pilot hydraulic pump 3 and having a pilot primary pressure is supplied to the arm hydraulic remote control valve 11 through oil paths 31, 32. The arm hydraulic remote control valve 11 is a variable pressure reduction valve. By operation of an operation lever 11-1 of the shovel loader 100, the pilot secondary pressure of the lever pressure-reduced according to a lever operation amount as illustrated in FIG. 4 is supplied to signal ports 7-1, 7-2 of the arm direction switching valve 7 through signal oil paths 33, 34, and a spool inside the arm direction switching valve 7 strokes such that the arm direction switching valve 7 is switched to the extension position 7E or the contraction position 7C. Of the hydraulic oil discharged from the pilot hydraulic pump 3, all of extra oil not supplied from the arm hydraulic remote control valve 11 to each of the signal ports 7-1, 7-2 of the arm direction switching valve 7 is discharged to the tank 15 through an oil path 35, a relief valve 13, and an oil path 36.

Specifically, the operation lever 11-1 is operated in an extension direction E, and accordingly, the arm direction switching valve 7 is switched to the extension position 7E and the hydraulic oil supplied from the main hydraulic pump 2 flows into a head chamber 9-1 of the arm cylinder 9 through the head-side oil path 25 connected to the oil path 23. At the same time, the hydraulic oil is discharged from a rod chamber 9-2 to the tank 15 through the oil path 24 connected to the rod-side oil path 26. In this manner, the arm cylinder 9 can be extended to lift the lift arm 109 (also shown as W1).

Moreover, the operation lever 11-1 is operated in a contraction direction C, and accordingly, the arm direction switching valve 7 is switched to the contraction position 7C and the hydraulic oil supplied from the main hydraulic pump 2 flows into the rod chamber 9-2 of the arm cylinder 9 through the rod-side oil path 26 connected to the oil path 23. At the same time, the hydraulic oil is discharged from the head chamber 9-1 to the tank 15 through the oil path 24 connected to the head-side oil path 25. In this manner, the arm cylinder 9 can be contracted to lower the lift arm 109 (also shown as W1).

Figure 5:
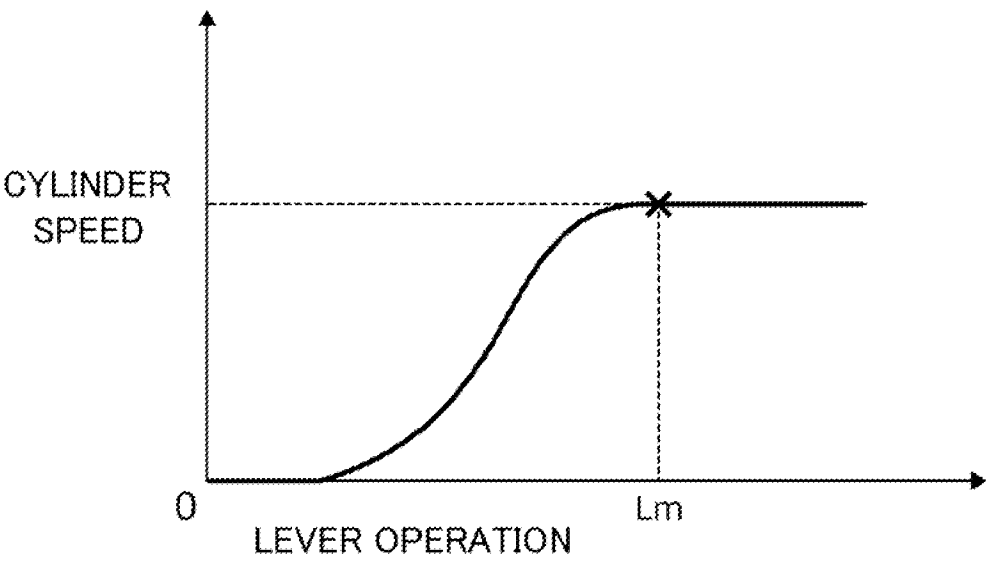
FIG. 5 is a graph for describing a relationship between the lever operation amount and an actuation speed (e.g., a cylinder speed) in an actuator (e.g., a cylinder) in the embodiment.

Note that a relationship between the lever operation amount and the cylinder speed (i.e., the actuation speed) of the arm cylinder 9 when the operation lever 11-1 is operated in the extension direction E shows a performance curve as illustrated in FIG. 5. Moreover, a relationship between a spool stroke in the arm direction switching valve 7 and a spool opening area when the operation lever 11-1 is operated in the extension direction E shows spool opening characteristics upon lifting of the lift arm 109 as illustrated in FIG. 6.

Figure 6:
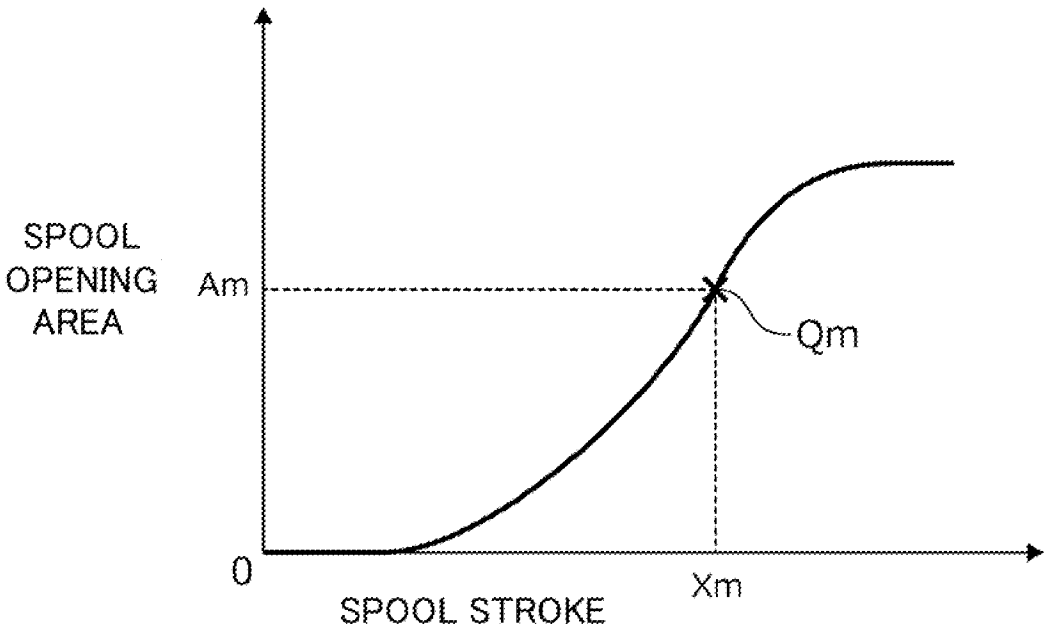
FIG. 6 is a graph for describing a relationship between a spool stroke and a spool opening area in a direction switching valve of the embodiment.
Figure 7:
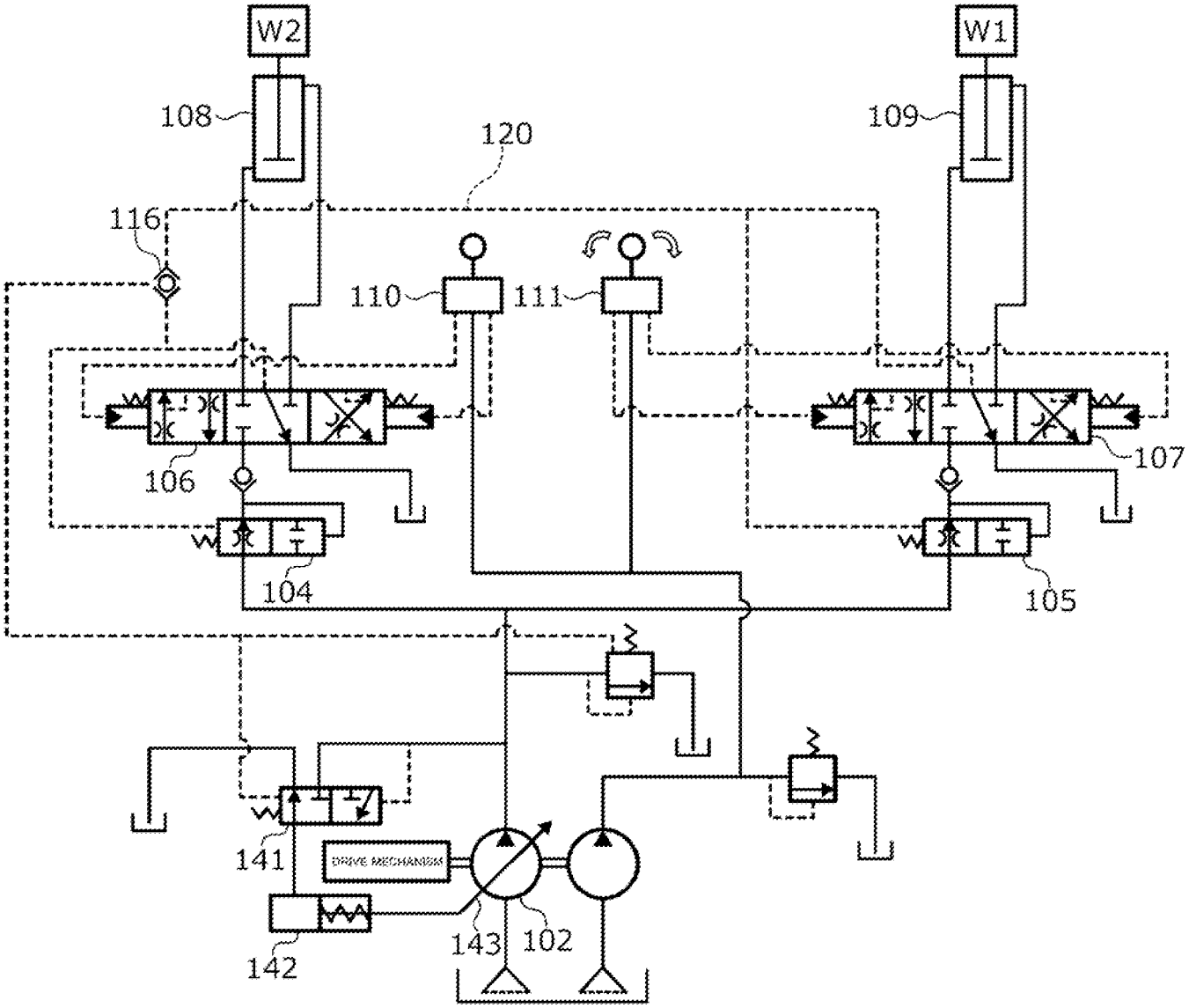
FIG. 7 is a diagram for describing a hydraulic circuit of a typical load sensing system.

As illustrated in FIG. 6, the arm direction switching valve 7 is set such that a spool opening for controlling the rate of inflow into the arm cylinder 9 from the main hydraulic pump 2 changes according to the spool stroke, i.e., the lever operation amount, and the rate Qm of inflow into the arm cylinder 9 from the main hydraulic pump 2 with respect to a spool opening area Am at a spool stroke Xm when the lever operation amount of the operation lever 11-1 is maximum Lm (see FIG. 5) is maximum. With this setting, a pressure loss in the spool opening of the arm direction switching valve 7 at the maximum cylinder speed of the arm cylinder 9 is reduced.

Note that the pressure compensation valves 4, 5 provided on the pressure fluid source sides of the bucket direction switching valve 6 and the arm direction switching valve 7 are two-port two-position type normally-opened pressure control valves. The pressure compensation valves 4, 5 are connected to the secondary pressure pilot pipe line 20 such that the load pressures of the bucket cylinder 8 and the arm cylinder 9 are each guided to the pressure compensation valves 4, 5. In simultaneous operation of the bucket direction switching valve 6 and the arm direction switching valve 7 configured to simultaneously drive the bucket 108 and the lift arm 109, the pressure compensation valves 4, 5 allow the flow rate according to the spool opening area of each direction switching valve to flow into the bucket cylinder 8 and the arm cylinder 9 regardless of the levels of the load pressures of the bucket cylinder 8 and the arm cylinder 9.

As described above, in the load sensing system, the pump flow rate control pressure is, according to the spool opening area in the direction switching valve, controlled in the load sensing valve 41 such that a pressure difference ΔP between before and after the direction switching valve is constantly a target value ΔPt (e.g., a constant value). The angle of inclination of the swash plate 43 of the main hydraulic pump 2 is increased/decreased by the swash plate control device 42 based on the pump flow rate control pressure, and in this manner, the output of the main hydraulic pump 2 is controlled. That is, as illustrated in FIG. 6, the output of the main hydraulic pump 2 is controlled such that a minute spool opening area results in a minute discharge amount from the main hydraulic pump 2 and the discharge amount increases as the spool opening area increases.

Note that the unload valve 12 connected to the secondary pressure pilot pipe line 20 is set such that the actuation pressure thereof is constantly higher than the supply pressure of the main hydraulic pump 2 by the target value ΔPt, and is configured such that the hydraulic oil (or its pressure) is released to the tank 15 when the pressure of the main hydraulic pump 2 becomes excessive. Moreover, the target value ΔPt is set by biasing force of a spring 12-1 built in the unload valve 12.

The accumulator 60 will be described herein. As illustrated in FIG. 2, a bypass oil path 63 is branched from the head-side oil path 25 of the arm cylinder 9, and the head-side oil path 25 is connected to the accumulator 60 through the bypass oil path 63, an electromagnetic switching valve 61, and bypass oil paths 64, 65. Moreover, the accumulator 60 is connected to the oil path 22 as a pressure-fluid-source-side flow path of the direction switching valve through the bypass oil paths 65, 66, an electromagnetic switching valve 62, and a bypass oil path 67.

The electromagnetic switching valves 61, 62 are two-port two-position type normally-closed electromagnetic switching valves. The electromagnetic switching valves 61, 62 are each connected to the controller 70 through electric signal lines 71, 72. At neutral positions, the electromagnetic switching valves 61, 62 are closed, and are opened by the electric signal from the controller 70. Note that the electromagnetic switching valves 61, 62 include built-in check valves, and in an open state, allow the flow of pressure fluid only in one direction.

Note that a signal pressure Pin is input to the controller 70 from a pressure sensor 80 provided at the oil path 21 and configured to detect the supply pressure of the main hydraulic pump 2, a signal pressure PLS is input to the controller 70 from a pressure sensor 81 provided at the secondary pressure pilot pipe line 20 and configured to detect the actuator maximum load pressure selected by the shuttle valve 16, a signal pressure PA is input to the controller 70 from a pressure sensor 82 as pressure detection means provided at the bypass oil path 65 and configured to detect the internal pressure of the accumulator 60, a signal pressure Px is input to the controller 70 from a pressure sensor 83 provided at the signal oil path 33 and configured to detect the pilot secondary pressure of the arm hydraulic remote control valve 11, and a signal pressure Py is input to the controller 70 from a pressure sensor 84 provided at the signal oil path 34 and configured to detect the pilot secondary pressure of the arm hydraulic remote control valve 11. Moreover, the arithmetic circuit of the controller 70 can calculate the direction switching valve pressure difference ΔP from the signal pressure Pin and the signal pressure PLS, can calculate the discharge amount of the accumulator 60 from the signal pressure PA, and can calculate the lever operation amount of the operation lever 11-1, i.e., the spool opening of the direction switching valve, from the signal pressure Px or the signal pressure Py.

Subsequently, operation of the accumulator 60 will be described. For example, when the operation lever 11-1 is operated in the contraction direction C, the signal pressure Py is input to the controller 70 from the pressure sensor 84 provided at the signal oil path 34, the electric signal is input to the electromagnetic switching valve 61 from the controller 70 through the electric signal line 71, and the electromagnetic switching valve 61 is opened. Accordingly, discharge oil as pressure fluid discharged from the head chamber 9-1 of the arm cylinder 9 to the tank 15 through the head-side oil path 25, i.e., part of the return oil from the arm cylinder 9, is accumulated in the accumulator 60 through the bypass oil paths 63, 64, 65.

When the operation lever 11-1 is operated in the extension direction E, the signal pressure Px is input to the controller 70 from the pressure sensor 83 provided at the signal oil path 33, the electric signal is input to the electromagnetic switching valve 62 from the controller 70 through the electric signal line 72, and the electromagnetic switching valve 62 is opened. Accordingly, the oil accumulated in the accumulator 60 is discharged to the oil path 22 through the bypass oil paths 65, 66, 67, and is recovered by the head chamber 9-1 of the arm cylinder 9 through the head-side oil path 25. At this point, the electric signal is, based on the internal pressure of the accumulator 60, simultaneously input to the electromagnetic proportional pressure reduction valve 50 from the controller 70 through the electric signal line 73, thereby adjusting the pressure reduction amount (the opening degree) of the electromagnetic proportional pressure reduction valve 50. In this manner, the actuator maximum load pressure guided to the load sensing valve 41 is reduced. Thus, in the load sensing valve 41, the opening degree is adjusted based on the difference between the supply pressure of the main hydraulic pump 2 and the actuator maximum load pressure adjusted by the electromagnetic proportional pressure reduction valve 50, i.e., the pressure difference between the pressure fluid source side of the direction switching valve and the actuator side of the direction switching valve adjusted by the electromagnetic proportional pressure reduction valve 50. With such an opening degree, the pump flow rate control pressure is controlled, and the swash plate control device 42 is actuated based on such a pump flow rate control pressure. The output of the main hydraulic pump 2 is decreased in such a manner that the angle of inclination of the swash plate 43 of the main hydraulic pump 2 is decreased.

For example, as illustrated in FIG. 5, when the lever operation amount of the operation lever 11-1 is maximum Lm, i.e., the rate Qm of inflow into the arm cylinder 9 from the main hydraulic pump 2 is maximum, in a case where a high load pressure is on the arm cylinder 9 and a hydraulic oil supply flow rate Qx necessary for the arm cylinder 9 is Qx>Qm, the electric signal is input to the electromagnetic switching valve 62 from the controller 70 through the electric signal line 72 to open the electromagnetic switching valve 62. In this manner, the oil accumulated in the accumulator 60 is recovered by the head chamber 9-1 of the arm cylinder 9, and recovery from the accumulator 60 can compensate for the output of the main hydraulic pump 2. At this point, when a relationship of Qx<Qm+QA is satisfied using a flow rate QA calculated by the controller 70 based on the internal pressure of the accumulator 60 and recovered by the arm cylinder 9 from the accumulator 60, the electric signal is simultaneously input to the electromagnetic proportional pressure reduction valve 50 from the controller 70 through the electric signal line 73, and the output of the main hydraulic pump 2 is decreased such that the rate of inflow into the arm cylinder 9 from the main hydraulic pump 2 satisfies Qx–QA.

According to such a configuration, the hydraulic circuit of the load sensing system of the present embodiment can discharge the pressure fluid accumulated in the accumulator 60 to the oil path 22 as the pressure-fluid-source-side flow path of the direction switching valve. A control amount by the load sensing valve 41 and the swash plate control device 42 as the discharge amount control mechanism is adjusted based on the internal pressure of the accumulator 60 by the electromagnetic proportional pressure reduction valve 50 provided at the secondary pressure pilot pipe line 20 configured to guide the actuator-side pressure of the direction switching valve to the load sensing valve 41. In this manner, compensation for the output of the main hydraulic pump 2 is allowed according to the internal pressure of the accumulator 60 which can be discharged to the pressure-fluid-source-side flow path of the direction switching valve. Thus, the load sensing system can respond to fluctuation in the load pressure of the actuator, and a high-energy-efficiency hydraulic circuit can be provided.

Moreover, when the pressure fluid is discharged from the accumulator 60 to the pressure-fluid-source-side flow path of the direction switching valve, the control amount by the load sensing valve 41 and the swash plate control device 42 is simultaneously adjusted by the electromagnetic proportional pressure reduction valve 50. Thus, the output of the main hydraulic pump 2 can be adjusted according to the internal pressure of the accumulator 60 at proper timing, leading to a favorable energy efficiency.

Further, the controller 70 can adjust the pressure reduction amount (or the opening degree) in the electromagnetic proportional pressure reduction valve 50 based on the supply pressure of the main hydraulic pump 2 as the pressure-fluid-source-side pressure of the direction switching valve detected by the pressure sensor 80, the actuator maximum load pressure as the actuator-side pressure of the direction switching valve detected by the pressure sensor 81, and the internal pressure of the accumulator 60 detected by the pressure sensor 82. Thus, the pressure difference ΔP between before and after the direction switching valve can be quickly controlled to the target value ΔPt. In addition, the controller 70 provides favorable responsiveness because the controller 70 actuates the electromagnetic proportional pressure reduction valve 50 by the electric signal.

Moreover, the electromagnetic proportional pressure reduction valve 50 is used so that the pressure reduction valve as the adjustment means can be simply configured.

Further, as illustrated in FIG. 3, the electromagnetic proportional pressure reduction valve 50 proportionally decreases the secondary pressure according to an increase in the electric signal from the controller 70, i.e., the electric signal for the solenoid, based on the internal pressure of the accumulator 60. Thus, the control amount by the load sensing valve 41 and the swash plate control device 42 can be finely controlled.

In addition, the bucket direction switching valve 6 and the bucket cylinder 8 are connected in parallel with the main hydraulic pump 2 in a fluid manner, and the arm direction switching valve 7 and the arm cylinder 9 are connected in parallel with the main hydraulic pump 2 in a fluid manner. The accumulator 60 is connected to the bypass oil paths 63, 64, 65, 66, 67 extending from the head-side oil path 25 of the arm cylinder 9. Thus, the hydraulic oil accumulated in the accumulator 60 can be supplied from the arm cylinder 9 to both of the bucket direction switching valve 6 and the bucket cylinder 8 and both of the arm direction switching valve 7 and the arm cylinder 9, leading to a favorable hydraulic circuit efficiency.

Moreover, the electromagnetic switching valve 62 is provided between the accumulator 60 and the oil path 22 as the pressure-fluid-source-side flow path of the direction switching valve. Thus, the pressure difference ΔP, which is calculated by the arithmetic circuit of the controller 70, between before and after the direction switching valve and the signal pressure PA based on the internal pressure of the accumulator 60 are compared, and the electromagnetic switching valve 62 is opened/closed as necessary such that the pressure difference ΔP between before and after the direction switching valve reaches the target value ΔPt. Consequently, the accumulated oil discharge amount from the accumulator 60 can be controlled.

Further, the controller 70 can compare the signal pressure PA as the internal pressure of the accumulator 60 detected by the pressure sensor 82 and the signal pressure Pin as the supply pressure of the main hydraulic pump 2 detected by the pressure sensor 80 to open/close the electromagnetic switching valve 62. Thus, only in a case where the internal pressure of the accumulator 60 is higher than the supply pressure of the main hydraulic pump 2 (PA>Pin), the electromagnetic switching valve 62 can be opened, and the accumulated oil can be reliably discharged from the accumulator 60.

In addition, in a variation, the electromagnetic switching valve 62 may be a proportional valve, and the opening degree may be adjusted according to an input value of the electric signal from the controller 70. With this configuration, the discharge amount from the accumulator 60 to the pressure-fluid-source-side flow path of the direction switching valve can be controlled according to an accumulation amount of the accumulator 60. According to such a configuration, the pressure difference ΔP between before and after the direction switching valve can be controlled to the target value ΔPt while balance between the discharge amount from the main hydraulic pump 2 and the discharge amount from the accumulator 60 is adjusted. Thus, the energy efficiency of the entirety of the hydraulic circuit is favorable.

The embodiment of the present invention has been described above with reference to the drawings, but specific configurations are not limited to such an embodiment. Even changes and additions made without departing from the gist of the present invention are included in the present invention.

For example, in the above-described embodiment, the hydraulic circuit of the shovel loader has been described as the fluid circuit of the load sensing system, but the present invention is not limited to such a circuit. The present invention may be applied to fluid circuits of other vehicles than the shovel loader, construction machines, industrial machines, etc. Moreover, the pressure fluid used in the fluid circuit may be liquid or gas other than the oil.

Moreover, in the above-described embodiment, the example where part of the oil discharged from the head chamber 9-1 of the arm cylinder 9 to the tank 15 through the head-side oil path 25 is accumulated in the accumulator 60 through the bypass oil paths 63, 64, 65 in contraction operation of the arm cylinder 9 and is recovered by the arm cylinder 9 through the oil path 22 in extension operation of the arm cylinder 9 has been described, but the present invention is not limited to such an example. Any hydraulic circuit can be applied as long as the hydraulic circuit performs accumulation/recovery by means of an accumulator 60 in a hydraulic circuit of a load sensing system of the prior art. For example, the hydraulic circuit may be configured such that part of return oil upon drive of the bucket cylinder 8 or upon braking of a not-shown running hydraulic motor of the shovel loader 100 is accumulated in the accumulator 60 and is recovered upon acceleration of the hydraulic motor.

Further, in the above-described embodiment, the form in which the electromagnetic proportional pressure reduction valve 50 is provided on the primary side of the load sensing valve 41 at the secondary pressure pilot pipe line 20 has been described. However, it may be configured such that the electromagnetic proportional pressure reduction valve is provided on a secondary side of the load sensing valve 41 to pressure-reduce the pump flow rate control pressure controlled by the load sensing valve 41, or it may be configured such that the output of the main hydraulic pump 2 is controlled independently of the secondary pressure pilot pipe line 20.

In addition, in the above-described embodiment, the example where the electromagnetic proportional pressure reduction valve 50 is used as the pressure reduction valve as the adjustment means has been described, but the pressure reduction valve as the adjustment means may be a pilot actuating type pressure reduction valve to be actuated by an external hydraulic signal.

Moreover, in the above-described embodiment, the form in which the hydraulic remote control valve is used to switch the supply destination of the hydraulic oil supplied from the pilot hydraulic pump 3 has been described, but the same also applies to the case of using an electric remote controller instead of the hydraulic remote control valve. An electric signal from the electric remote controller may be directly input to the controller.

Further, in the above-described embodiment, the form in which the discharge amount control mechanism increases/decreases the angle of inclination of the swash plate 43 of the main hydraulic pump 2 by actuation of the swash plate control device 42 based on the pump flow rate control pressure controlled by the load sensing valve 41 to control the output of the main hydraulic pump 2 has been described, but the present invention is not limited to such a form. The discharge amount control mechanism may control the output of the main hydraulic pump 2 by an electric signal.

In addition, in the above-described embodiment, the configuration in which the pressure reduction valve as the adjustment means is provided at the secondary pressure pilot pipe line 20 has been described, but a pressure increase mechanism as the adjustment means may be provided at the primary pressure pilot pipe line 28.

Moreover, the pressure-fluid-source-side pressure and the actuator-side pressure of the direction switching valve are not necessarily input by the pilot pipe line, but may be input using an electric signal.

Further, a bypass oil path and an electromagnetic switching valve may be provided at the accumulator 60 so that accumulation from the bucket-cylinder-8-side hydraulic circuit can be also performed.

In addition, a single actuator may be provided at the hydraulic circuit.

REFERENCE SIGNS LIST

1 Drive mechanism
2 Main hydraulic pump (pressure fluid source)
3 Pilot hydraulic pump
4, 5 Pressure compensation valve
6 Bucket direction switching valve (direction switching valve)
7 Arm direction switching valve (direction switching valve)
8 Bucket cylinder (actuator)
9 Arm cylinder (actuator)
10 Bucket hydraulic remote control valve
11 Arm hydraulic remote control valve
12 Unload valve
13 Relief valve
15 Tank
16 Shuttle valve
20 Secondary pressure pilot pipe line (pilot pipe line)
22 Oil path (pressure-fluid-source-side flow path of direction switching valve)
25 Head-side oil path
26 Rod-side oil path
27 Primary pressure pilot pipe line (pilot pipe line)
37 Accumulator
41 Load sensing valve (discharge amount control mechanism)
42 Swash plate control device (discharge amount control mechanism)
43 Swash plate
50 Electromagnetic proportional pressure reduction valve (adjustment means, pressure reduction valve)
60 Accumulator
61, 62 Electromagnetic switching valve
63 to 67 Bypass oil path
70 Controller (control unit)
80, 81 Pressure sensor
82 Pressure sensor (pressure detection means)
100 Shovel loader
108 Bucket
109 Lift arm

The invention claimed is:

1. A fluid circuit including a pressure fluid source configured to supply pressure fluid, multiple actuators connected to the pressure fluid source, a direction switching valve configured to switch a supply destination of the pressure fluid supplied from the pressure fluid source, and a discharge amount control mechanism configured to control output pressure of the pressure fluid source such that a pressure difference between the output pressure of the pressure fluid source and a maximum load pressure of load pressures of the multiple actuators reaches a target value, comprising:

an accumulator configured to accumulate part of return fluid from the actuators, wherein the accumulator is able to discharge the pressure fluid from the accumulator to a pressure-fluid-source-side flow path of the direction switching valve, and pressure adjustment valve configured to adjust a control amount of the pressure fluid source based on a pressure of the accumulator is further provided.

2. The fluid circuit according to claim 1, wherein the control amount is adjusted by the pressure adjustment valve when the pressure fluid is discharged from the accumulator to the pressure-fluid-source-side flow path of the direction switching valve.

3. The fluid circuit according to claim 1, further comprising:

a pressure sensor configured to detect the pressure of the accumulator; and a control unit having an arithmetic circuit, wherein the pressure adjustment valve is actuated by an electric signal output from the control unit based on the pressure detected by the pressure sensor.

4. The fluid circuit according to claim 1, wherein the discharge amount control mechanism includes a load sensing valve configured to adjust an opening degree of the load sensing valve based on a difference between pressure-fluid-source-side pressure and actuator-side pressure of the direction switching valve guided by a pilot pipe line, and a pressure reduction valve as the pressure adjustment valve is provided at the pilot pipe line guiding the actuator-side pressure of the direction switching valve.

5. The fluid circuit according to claim 4, wherein a pressure reduction amount in the pressure reduction valve is adjusted based at least on the pressure-fluid-source-side pressure and the actuator-side pressure of the direction switching valve and the pressure of the accumulator.

6. The fluid circuit according to claim 2, further comprising:

a pressure sensor configured to detect the pressure of the accumulator; and a control unit having an arithmetic circuit, wherein the pressure adjustment valve is actuated by an electric signal output from the control unit based on the pressure detected by the pressure sensor.

7. The fluid circuit according to claim 2, wherein the discharge amount control mechanism includes a load sensing valve configured to adjust an opening degree of the load sensing valve based on a difference between pressure-fluid-source-side pressure and actuator-side pressure of the direction switching valve guided by a pilot pipe line, and a pressure reduction valve as the pressure adjustment valve is provided at the pilot pipe line guiding the actuator-side pressure of the direction switching valve.

8. The fluid circuit according to claim 7, wherein a pressure reduction amount in the pressure reduction valve is adjusted based at least on the pressure-fluid-source-side pressure and the actuator-side pressure of the direction switching valve and the pressure of the accumulator.

9. The fluid circuit according to claim 3, wherein the discharge amount control mechanism includes a load sensing valve configured to adjust an opening degree of the load sensing valve based on a difference between pressure-fluid-source-side pressure and actuator-side pressure of the direction switching valve guided by a pilot pipe line, and a pressure reduction valve as the pressure adjustment valve is provided at the pilot pipe line guiding the actuator-side pressure of the direction switching valve.

10. The fluid circuit according to claim 9, wherein a pressure reduction amount in the pressure reduction valve is adjusted based at least on the pressure-fluid-source-side pressure and the actuator-side pressure of the direction switching valve and the pressure of the accumulator.

11. The fluid circuit according to claim 6, wherein the discharge amount control mechanism includes a load sensing valve configured to adjust an opening degree of the load sensing valve based on a difference between pressure-fluid-source-side pressure and actuator-side pressure of the direction switching valve guided by a pilot pipe line, and a pressure reduction valve as the pressure adjustment valve is provided at the pilot pipe line guiding the actuator-side pressure of the direction switching valve.

12. The fluid circuit according to claim 11, wherein a pressure reduction amount in the pressure reduction valve is adjusted based at least on the pressure-fluid-source-side pressure and the actuator-side pressure of the direction switching valve and the pressure of the accumulator.

* * * * *